US012595659B2

(12) United States Patent
Borsoi et al.

(10) Patent No.: US 12,595,659 B2
(45) Date of Patent: Apr. 7, 2026

(54) ROLLER AWNING WITH LIGHTS

(71) Applicant: TELECO AUTOMATION S.R.L., Treviso (IT)

(72) Inventors: Luigi Borsoi, Treviso (IT); Roberto Collovini, Treviso (IT)

(73) Assignee: TELECO AUTOMATION S.R.L., Treviso (IT)

( * ) Notice: Subject to any disclaimer, the term of this patent is extended or adjusted under 35 U.S.C. 154(b) by 239 days.

(21) Appl. No.: 18/496,952

(22) Filed: Oct. 30, 2023

(65) Prior Publication Data

US 2024/0151039 A1 May 9, 2024

(30) Foreign Application Priority Data

Nov. 4, 2022 (IT) ..... 102022000022728

(51) Int. Cl.
*E04F 10/06* (2006.01)

(52) U.S. Cl.
CPC ..... *E04F 10/0618* (2013.01); *E04F 10/0648* (2013.01); *E04F 10/0666* (2013.01)

(58) Field of Classification Search
CPC ..... E04F 10/0666; A45B 3/02; A45B 3/04; G02B 6/0005; G02B 6/0096
See application file for complete search history.

(56) References Cited

U.S. PATENT DOCUMENTS

| | | | | |
|---|---|---|---|---|
| 4,848,385 | A * | 7/1989 | Pennella | A45B 3/04 135/910 |
| 5,148,849 | A * | 9/1992 | Faludy | B60P 3/343 160/67 |
| 7,117,565 | B2 * | 10/2006 | Brutsaert | E04F 10/0618 16/386 |
| 10,704,324 | B2 * | 7/2020 | Goldberg | E06B 9/50 |
| 11,097,644 | B2 * | 8/2021 | McKinnon | B60J 3/002 |
| 2003/0230331 | A1 * | 12/2003 | Li | A45B 3/04 362/7 |
| 2008/0122382 | A1 * | 5/2008 | Moriconi | H05B 47/155 315/291 |

(Continued)

FOREIGN PATENT DOCUMENTS

| | | | |
|---|---|---|---|
| DE | 202004-18182 | U1 | 3/2005 |
| EP | 2119847 | A1 | 11/2009 |

(Continued)

*Primary Examiner* — Abe Massad
(74) *Attorney, Agent, or Firm* — Carmel Patent Agency; Robert Ballarini

(57) ABSTRACT

A roller awning, with lights, includes: a sheet; a shaft for winding/unwinding it; a structure supporting the shaft; a crosspiece for constraining an edge of the sheet; pairs of articulated arms for supporting and moving the crosspiece with respect to the support structure; and a plurality of LED lights fixed at least to the articulated arms. Articulation is obtained through disks fixed to cooperating ends of the arms, the disks being intercalated between them and being crossed by an articulation pin, forming an articulation joint with the discs. The pin being hollow and has its upper end opening into an upper cavity which is obtained in the upper disc of the joint and which also houses a printed circuit board. At least one LED is mounted thereon facing an axial cavity of the pin, within which, a light guide is housed opening at the lower end of the axial cavity.

20 Claims, 1 Drawing Sheet

(56) References Cited

U.S. PATENT DOCUMENTS

| | | | | |
|---|---|---|---|---|
| 2014/0043845 | A1* | 2/2014 | Chen | F21K 9/61<br>362/555 |

FOREIGN PATENT DOCUMENTS

| | | | | |
|---|---|---|---|---|
| EP | 2902565 | A1 | 8/2015 | |
| EP | 3662203 | B1 * | 9/2021 | F21V 23/0435 |
| WO | 2019026032 | A1 | 8/2018 | |

* cited by examiner

ROLLER AWNING WITH LIGHTS

CROSS-REFERENCE TO RELATED APPLICATIONS

This application claims benefit to Italian Patent Application No. 102022000022728, filed Nov. 4, 2022, the entire contents of which are incorporated by reference herein as if fully set forth.

FIELD OF TECHNOLOGY

The present invention concerns a roller awning with lights.

BACKGROUND

Roller awnings are known comprising a sheet, which in the retracted awning condition is wound on a tubular shaft and in the unfolded awning condition it is unwound by said shaft and is kept extended by its connection with an edge to said tubular shaft and with the opposite edge to a rigid crosspiece, which can be moved closer or further away from the tubular shaft itself.

In the case of a cantilever awning, the tubular mast is supported by a support structure essentially consisting of a C-shaped bracket with the central wing attached to a wall and with the lateral wings supporting the tubular mast at its ends. Two pairs of articulated arms are also attached to the central wing of the C-shaped bracket, which when the sheet is unwound from the tubular shaft extend under the weight of the crosspiece, of the arms themselves and of the unwrapped portion of the sheet, and when the sheet is wrapped on the tubular shaft, they fold in opposite directions due to the bringing of the crosspiece closer to the support brackets of the tubular shaft.

The shape of the crosspiece is preferably such that, when the sheet is completely wrapped, the assembly formed by the C-shaped bracket and the crosspiece placed next to it defines a sort of closed container which houses the tubular shaft inside with the sheet completely wrapped around it. it, the pairs of folded articulated arms and the electromechanical and electronic equipment for moving, commanding and controlling the awning.

EP2119847 describes a roller awning in which the articulation of the arms is obtained through discs which are fixed to the ends of said arms, which are interspersed each other with and are crossed by an articulation pin, which forms an articulation joint with said discs.

It is also known from EP 3662203 to apply a plurality of lights, in particular LED strips, to the lower edge of the articulated arms and/or of the crosspiece and/or of the support structure, which illuminate the underlying surface of the awning or create plays of light and in particular RGB effects.

In the particular case of LED strips applied to the articulated arms, they are connected to a power supply preferably housed inside the tubular shaft together with a radio receiver with LED output control driver or to a radio transceiver, which in addition to receiving commands for activation/regulation of the LED outputs, it can transmit signals on the status of the LEDs themselves, so that the user can remotely control, via a radio control or even via mobile phone (e.g. smartphone), the switching on, off and regulation of the LEDs and can receive, again with the mobile phone, information on the current status of these.

Since the movement arms of the crosspiece are articulated each other to at a joint, evidently the LED strip must be interrupted at this joint, since it could not flex to follow the articulated movements of one arm with respect to the other arm of the pair. It follows that the light strip created by the LEDs applied to the articulated arms must in any case be interrupted at the articulation joint of the arms themselves and this is undesirable as it contrasts with the aesthetic result that the LED strip aims to create. Furthermore the application of an isolated LED on the lower surface of the joint does not appear to be a satisfactory solution, both due to the need to power that LED with an unsightly electrical conductor visible from underneath the unfolded curtain, and due to the risk that at the end of the folding phase of the arms, i.e., when they are made to enter the container formed by the C-shaped bracket of the awning support structure and the crosspiece supported by the articulated arms, the LED can interfere with the movements of the various components of the awning and could be so damaged.

SUMMARY

The aim of the invention is to eliminate this drawback and to create a luminous continuity along the entire length of the articulated arms.

Another aim of the invention is to propose a roller awning which allows the drawbacks of known solutions at least in part to be overcome.

Another aim of the invention is to obtain substantial luminous continuity along the articulated arms without having electrical power wires visible from underneath the unfolded awning.

Another aim of the invention is to obtain this luminous continuity without substantially altering the external appearance of the awning and its support and movement structure.

Another aim of the invention is to obtain this luminous continuity by eliminating risks of hindering the movements of the articulated arms when closing the awning.

Another aim of the invention is to create this luminous continuity by eliminating risks of damage to the light sources applied in the articulation joint of the folding arms when the awning is retracted.

Another aim of the invention is to create this luminous continuity with minimal modifications of a traditional roller awning which does not present this luminous continuity.

Another aim of the invention is to propose a roller awning which allows to obtain a pleasant overall aesthetic effect and which provides the observer with the sensation of being faced with a high-quality product, both on an aesthetic and functional level.

Another aim of the invention is to propose a roller awning which can be obtained simply and quickly.

Another aim of the invention is to propose a roller awning that can be mass-produced quickly and efficiently.

Another aim of the invention is to propose a roller awning that is easy and quick to assemble and install.

Another aim of the invention is to propose a roller awning which is of high standards, both functional and aesthetic, and at the same time of affordable cost, thus allowing the possibility of its widespread diffusion.

Another aim of the invention is to propose a roller awning that has an alternative characterization, both in constructive and functional terms, compared to traditional ones.

All these objects and others that will appear from the following description are achieved according to the invention with a roller awning with lights as defined below.

BRIEF DESCRIPTION OF THE DRAWINGS

The present invention is further clarified below in some of its preferred practical embodiments reported for purely illustrative and non-limiting purposes with reference to the attached drawings, in which.

DETAILED DESCRIPTION OF THE PREFERRED EMBODIMENTS

Figure 1:
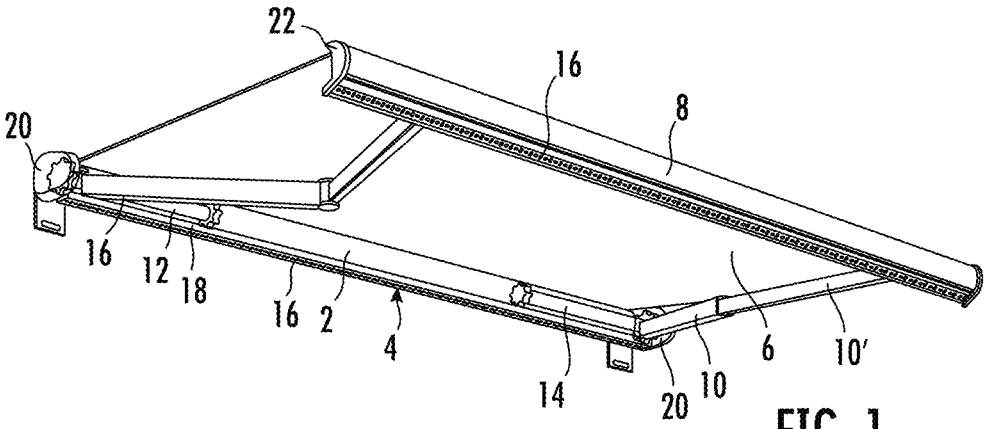
FIG. 1 shows a perspective view of a roller awning according to the invention in the unfolded condition.
Figure 2:
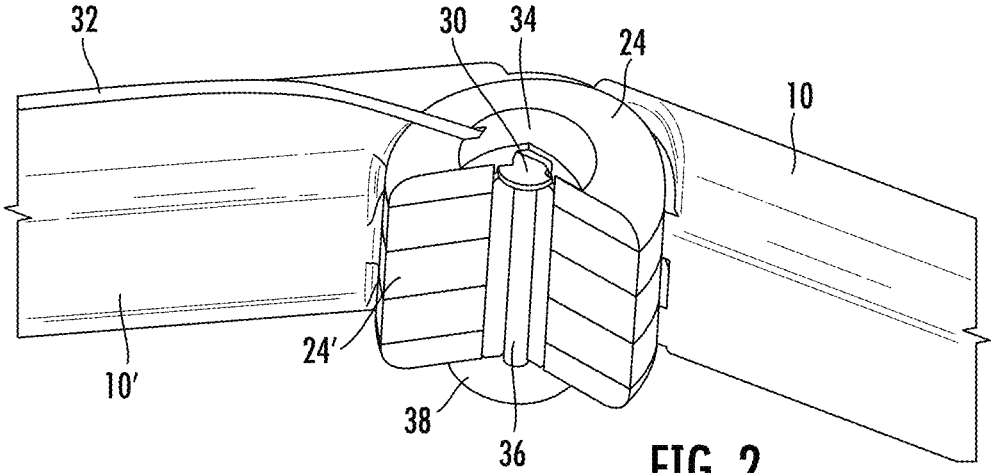
FIG. 2 shows a partially sectioned perspective view of the enlarged detail of an articulation joint of two arms.
Figure 3:
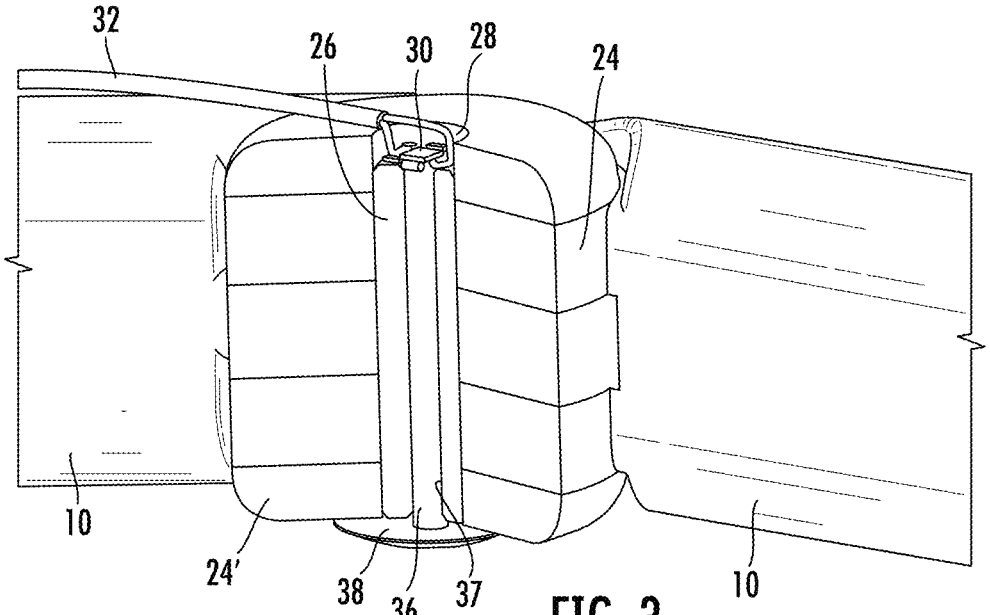
FIG. 3 shows it in a different perspective view with some details removed.

As can be seen from the figures, the roller awning according to the invention is traditional in itself and includes a tubular shaft 2, a support structure 4 of the tubular shaft 2, a sheet 6 (or similar/equivalent covering element) which can be wrapped around the tubular shaft 2 and unrolled from this, a rigid crosspiece 8, to which the edge of the sheet 6 is applied opposite to that constrained by the tubular shaft 2, and two pairs of articulated arms 10,10' which connect the rigid crosspiece 8 to the support structure 4 and they guide its translational movements with respect to it.

The tubular shaft 2 can advantageously be a metal shaft, or made of other material, with a hexagonal or octagonal section or similar, of the type traditionally used for curtains and/or roller shutters.

The tubular shaft 2 can house inside it a traditional tubular motor 12 for rotating the awning, and also the shaft 2 for winding/unwinding the said sheet 6.

The tubular shaft 2 can house inside it a traditional device 14 for powering and controlling a plurality of light sources, in particular LED lights.

Preferably, inside the tubular shaft 2 there is housed a radio receiver or a radio transceiver with driver for controlling the LED outputs, which, in addition to receiving commands for activating/adjusting the LED outputs, can transmit signals on the status of the LEDs themselves, in so that the user can remotely control, via a radio control or even via smartphone or similar, the switching on, off and adjustment of the LEDs and can receive, again with the smartphone or similar, information on the current status of these.

Preferably, said LED lights are made up of LED strips 16 applied to the support structure 4 and/or to the crosspiece 8 and/or to the articulated arms 10.

Preferably, the support structure 4 is essentially made up of a C-shaped bracket, with a central wing 18, at which the structure 4 is fixed to a wall and with two lateral wings 20, which protrude outwards and they are configured to support the tubular shaft 2 and everything contained therein.

Preferably, the crosspiece 8 is made up of a profile with an arched section. Preferably, the crosspiece 8 is provided at the ends with two closing elements 22 having a shape complementary to the shape of the lateral wings 20 of the support structure 4, so that when the crosspiece adheres to this it defines with it a closed container which is housed in its inside the sheet 6 completely wrapped around the tubular shaft 2 and the two pairs of articulated arms 10, 10' completely folded.

Preferably, the articulation joint between the two articulated arms 10,10' of each pair provides that one end of each arm is provided with discs 24,24' centrally perforated and configured so that they can be inserted between them to be crossed by a single pin 26, internally hollow, around which they can articulate. Conveniently, as can be seen from the figures, the pin 26 extends longitudinally and is open at its mutually opposite longitudinal ends; conveniently, as can be seen from the figures, the pin 26 is hollow and, in particular, includes an axial cavity 37 inside it.

In particular, the disks 24,24' are integral with/fixed respectively to the arms 10, 10'.

Preferably, in a possible embodiment illustrated in the figures, two disks 24 are integral with the arm 10 while three disks 24' are integral with the arm 10', which in the joint formed are arranged one between the two disks 24 of the arm 10 and two externally to these two discs 24. Preferably, a number of disks are attached to one arm which is one unit greater than the disks of the other arm.

Preferably, the discs 24, 24' are rounded, in particular at their outermost edge, similarly to the longitudinal edges of the arms 10, 10', to give the whole a linear and aesthetically pleasing appearance.

The ends of the hollow pin 26 stop at the two external disks 24'. Preferably, the pin 26 is mounted neutrally with respect to all the disks 24 and is instead made integral with at least one of the disks 24' by any traditional means, and in particular by means of screws.

Inside an upper cavity 28, preferably cylindrical shape, obtained in the upper disk 24', at the upper end of the pin 26, a printed circuit board 30 is applied, on which one or more LEDs are mounted, which face the axial cavity 37 of the pin itself.

The printed circuit board 30 is powered via a cable 32, which is fixed or associated with the upper edge of the arm 10' and enters the cylindrical cavity 28. Conveniently, the cable 32 can run along the upper edge of one of the two articulated arms 10 or 10' (which can be the arm to which the upper disc is attached or the other one).

Conveniently, in a possible embodiment not shown, the printed circuit board 30 is provided with a power battery for said at least one LED mounted on the board itself.

Preferably, the cavity 28 is then closed by a removable plug 34 preferably having the shape of a spherical cap, more preferably a flattened spherical cap. Preferably, the plug 34 can be crossed by the cable 32.

Inside the axial cavity 37 of the pin 26 there is a light guide 36, which has the upper end facing the LED fixed to the printed circuit board 30 and the lower end opening at the lower end of the axial cavity 37 of said pin 26.

Preferably, a light diffuser 38 is associated with the lower end of said light guide 36. Preferably, the lower end of the light guide 36 extends into a light diffuser 38. Conveniently, the light diffuser 38 can be single body with the light guide 36 or it can be removably fastened to the light guide 36 and/or to the axial cavity 37 of the pin 26.

Preferably, said light diffuser 38 has the shape of a spherical cap. Preferably, the shape of the light diffuser 38 is similar to the shape of the plug 34 closing the cavity 28.

Advantageously in this way, when the awning is unfolded, the light generated by the LED mounted on the printed circuit board 30 and preferably diffused by the light diffuser 38 creates substantial continuity with the light strips generated by the LEDs 16 applied to the lower edge of the arms 10,10', thus eliminating the inconvenience found in roller blinds with arms equipped with LED strips.

Furthermore, advantageously, the elimination of this drawback is achieved without substantially modifying the traditional conformation of the articulation joints of the arms 10,10' of a traditional roller awning, but simply by replacing the articulation pin of the latter with the hollow pin 26 provided with board 30 provided with LEDs, with light guide 36 and, preferably, with diffuser 38.

This allows you to modify the articulation joint of the arms of a traditional awning with a rather simple operation, which can also be carried out in existing awnings but not provided with this functionality.

Finally, advantageously, the power supply of the LED, which allows the articulation joint between the two arms 10, 10' to perform this new function, is obtained with a cable 32 which runs above one of the arms 10' and that is in position not visible as it is located on the opposite side to that intended for users of the tent.

The present invention has been illustrated and described in some of its preferred embodiments, but it is understood that executive variations may be made to them in practice, without however departing from the scope of protection of the present patent for industrial invention.

What is claimed is:

1. A roller awning, with lights, the roller awning comprising:

a sheet, a shaft for winding or unwinding said sheet, a structure to support said shaft, a crosspiece, said sheet having a first edge attached to said crosspiece and a second edge attached to said shaft, a pair of two articulated arms for supporting and moving said crosspiece with respect to said structure, and a plurality of LED lights fixed at least to said articulated arms, wherein articulation between two of said arms is obtained through a plurality of discs which are fixed to cooperating ends of each of said arms, said discs being interleaved and being crossed by an articulation pin, which forms an articulation joint with said discs, and wherein said pin is hollow and has an upper end opening into an upper cavity which is located in an uppermost disc of the interleaved discs, said upper cavity housing a printed circuit board, at least one LED is mounted on said circuit board in a position facing an axial cavity of said pin, within said axial cavity a light guide is housed which opens at a lower end of the axial cavity of said pin.

2. The roller awning according to claim 1, further comprising a light diffuser at a lower end of said light guide.

3. The roller awning according to claim 2, wherein said light diffuser is a spherical cap.

4. The roller awning according to claim 1, wherein the upper cavity of said uppermost disc is closed by a plug which is removable.

5. The roller awning according to claim 4, wherein said plug is a spherical cap.

6. The roller awning according to claim 1, further comprising a light diffuser at a lower end of said light guide and a plug closing said upper cavity.

7. The roller awning according to claim 1, wherein said hollow pin is fastened to at least one of the discs integral with one of the two articulated arms and is idle compared to each of the discs integral with the other articulated arm.

8. The roller awning according to claim 1, wherein said printed circuit board is powered via a cable which runs along an upper edge of the articulated arm, to which said uppermost disc is fixed.

9. The roller awning according to claim 1, wherein said printed circuit board is powered by a cable which runs along an upper edge of one of the two articulated arms.

10. The roller awning according to claim 1, wherein said plurality of LED lights includes LED strips.

11. The roller awning according to claim 1, wherein at least two of the discs are attached to one arm while at least three of the discs are attached to the other arm.

12. The roller awning according to claim 1, wherein said discs are rounded.

13. The roller awning according to claim 1, wherein longitudinal edges of the arms are rounded.

14. The roller awning according to claim 1, wherein LED lights are fixed to the rigid crosspiece and/or to the structure.

15. The roller awning according to claim 1, wherein a tubular motor is housed inside the tubular shaft for rotating the shaft of said sheet.

16. The roller awning according to claim 1, wherein a device for powering and controlling said LED lights is housed inside the tubular shaft.

17. The roller awning according to claim 1, wherein said crosspiece and said structure are configured so that the crosspiece abuts the structure, defining a closed container, which houses therein, the sheet when completely wrapped around the tubular shaft and when the two pairs of articulated arms are completely folded.

18. The roller awning according to claim 1, wherein the upper end and a lower end of the hollow pin align with the uppermost disc and a lowermost disc, said uppermost disc and said lowermost disc being provided on one of said two articulated arms.

19. The roller awning according to claim 1, wherein said light diffuser is in a single body with the light guide.

20. The roller awning according to claim 1, wherein said light diffuser is removably fastened to at least one of the light guide or the axial cavity of the pin.

* * * * *